US006601506B2

(12) United States Patent
Dauer

(10) Patent No.: US 6,601,506 B2
(45) Date of Patent: Aug. 5, 2003

(54) DETERMINING THE PRESETTING DATA FOR THE CUT REGISTER AND/OR COLOR REGISTER (CIRCUMFERENTIAL REGISTER) FOR PRINTING MECHANISMS WITH NO LINESHAFT

(75) Inventor: Horst Dauer, Rohrbach (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 169 days.

(21) Appl. No.: 09/732,354

(22) Filed: Dec. 7, 2000

(65) Prior Publication Data

US 2002/0029706 A1 Mar. 14, 2002

(30) Foreign Application Priority Data

Aug. 3, 2000 (DE) ..... 100 38 551

(51) Int. Cl.[7] ..... B41F 13/24

(52) U.S. Cl. ..... 101/248; 101/228; 101/483; 101/177; 101/183

(58) Field of Search ..... 101/248, 222, 101/228, 177, 183, 483, 485

(56) References Cited

U.S. PATENT DOCUMENTS 5,016,182 A * 5/1991 Bergland et al. ..... 101/248
5,062,360 A * 11/1991 Germann et al. ..... 101/177
5,088,403 A * 2/1992 Shoji et al. ..... 101/248
5,309,834 A * 5/1994 Koch ..... 101/248
5,361,960 A * 11/1994 Fokos et al. ..... 101/248
6,092,466 A 7/2000 Koch et al. ..... 101/485
6,422,552 B1 * 7/2002 Chesno et al. ..... 101/483

FOREIGN PATENT DOCUMENTS

| | | |
|---|---|---|
| DE | 44 30 693 | 3/1996 |
| DE | 92 18 978 | 8/1996 |
| DE | 197 21 212 | 11/1998 |
| EP | 950 519 | 10/1999 |

OTHER PUBLICATIONS

Article entitled *Mehromotorenantrieb für Rotations–druck-maschinen* by Von Siegfried Meyer and Ernst Sondermann appearing in Siemens–Zeitschrift 51 (1977) Heft 5, pp. 387–394.

Article entitled "*Investitionsentscheidende Kriterien bei der Installation eines Register–steuersystems im Zeitungsdruck*" by Von Jeff Isherwood, 4 pp.

* cited by examiner

*Primary Examiner*—Eugene H. Eickholt
(74) *Attorney, Agent, or Firm*—Cohen, Pontani, Lieberman & Pavane

(57) ABSTRACT

Determining presetting data for the cut register and/or color register (circumferential register) for printing mechanisms with no lineshaft. Using sensor, the web lengths needed for the respective print job are determined and are used to calculate presetting values for the cylinders involved in the printing.

9 Claims, 1 Drawing Sheet

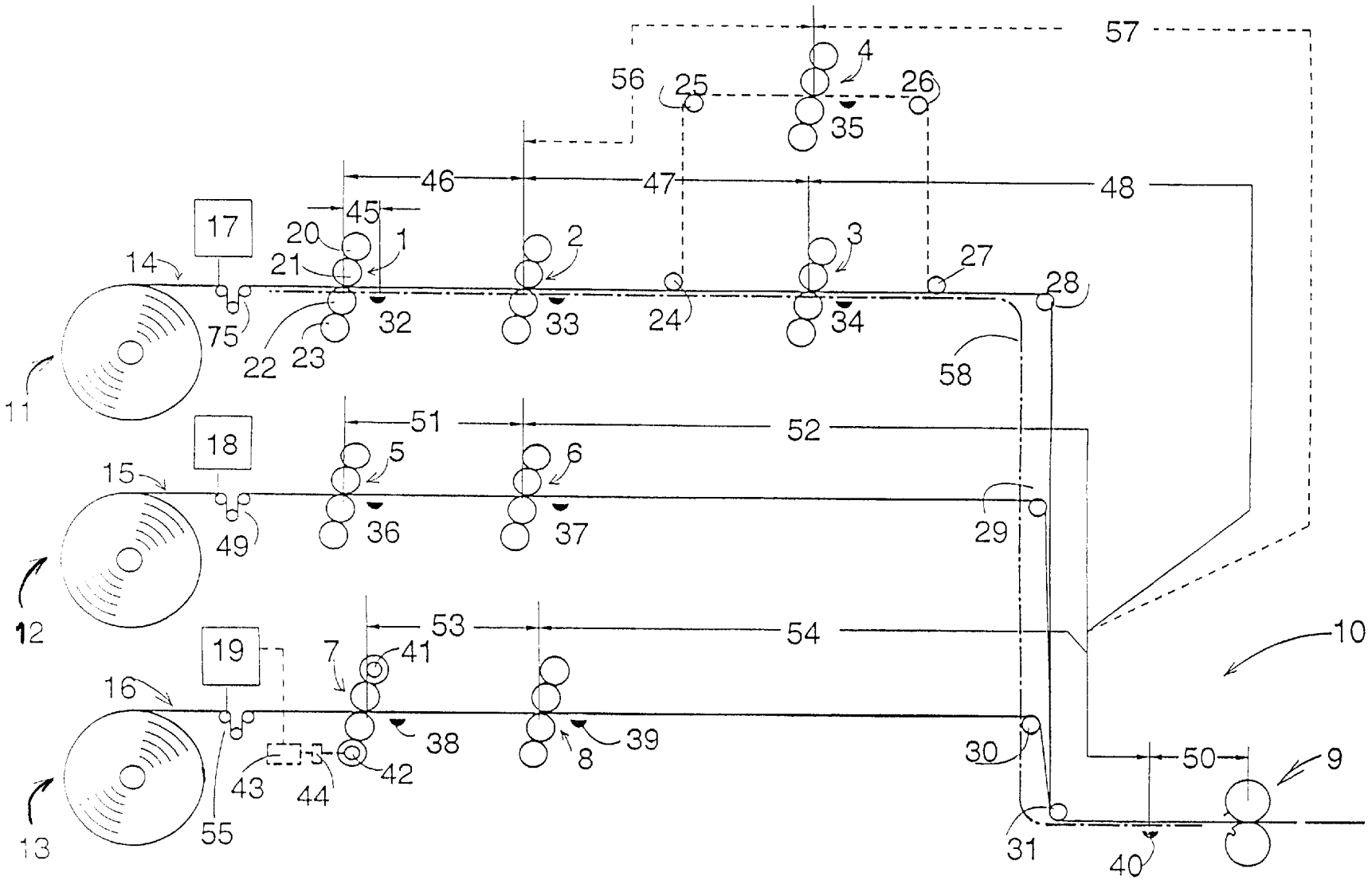
10
9
50
40
57
48
28
31
29
30
27
58
26
4
35
3
34
52
54
25
24
47
56
39
8
2
33
6
37
46
51
53
38
41
42
1
32
5
36
45
7
44
20
21
23
22
43
17
75
18
49
19
55
14
15
16
11
12
13

DETERMINING THE PRESETTING DATA FOR THE CUT REGISTER AND/OR COLOR REGISTER (CIRCUMFERENTIAL REGISTER) FOR PRINTING MECHANISMS WITH NO LINESHAFT

BACKGROUND OF THE INVENTION

The invention relates to a web-fed rotary offset printing machine.

Printing machines with multiple motor drives instead of lineshafts are already known from Siemens Zeitschrift 51 (1977) volume 5, pages 387 to 394 and from the journal "Zeitungstechnik" [newspaper technology], December 1991, pages 78 to 80. In these known printing machines, in each case a plate cylinder is driven by a separate drive motor. The printing mechanisms are already equipped with angle and register control systems, but this prior art does not disclose any possible way in which, with different web paths for different print jobs, the cylinders involved in the printing are to be prepared. Obviously, with the aid of the existing register control system, during printing operation or during transport of the printing-material web, adaptation of the angular positions of the printing cylinders is performed. This gives rise to a high start-up reject rate, since the speed of adjustment during printing can take place only slowly. An excessively high adjustment speed would lead to a web break or to the formation of loops between the printing mechanisms, which is additionally associated with the risk of the web being wound up on one of the printing cylinders. In the case of single-web operation, the cut register can be changed by changing the rotary angle position of the cutting cylinder. During operation, the cut-register control system acts on the rotary angle position of the cutting roll. In the case of multi-web operation, the printing units of all the webs have to be set to the cut register. In a sense, the rotary angle position of the cutting cylinder is the master, to which the angular positions of the individual printing mechanism cylinders have to be adapted. During operation, a cut-register control system ensures the optimum setting of the rotary angle position of the printing cylinders in relation to the cutting cylinder.

During printing operation with optional web guidance, as is needed in particular in newspaper presses, the necessary rotary angle position of the cylinders involved in the printing changes very sharply when the web guidance is changed. German laid-open specification DE-44 30 693 A1 has already disclosed using presetting values with the aid of which, in order to adapt to different web paths and/or production configurations (cut register), presetting of the cylinders involved in the printing is possible for the color register (circumferential register) and the cut register. This results in a simple construction of the machine and/or of the machine control system, and a lower occurrence of rejects in each case when starting up the machine.

SUMMARY OF THE INVENTION

On this basis, an object of the present invention is to determine presetting data for the cut register and/or the color register (circumferential register for shaftless printing mechanisms so that, in particular before the beginning of the printing process, optimum presetting is possible by driving the drive motors, without manual interventions or further mechanical adjustments being necessary.

The essence of the invention is that a "measurement of the distances" of the respectively activated printing mechanisms or printing points in relation to one another and to the cut edge in the cutting unit is carried out. The respective web length from printing mechanism to cut edge provides the appropriate angle setting. Using an on-line determination (calculation), the respectively applicable or necessary rotary angle position of the printing cylinders is determined, as referred to the current angular position of the cutting cylinder. By means of the individual drive technique, each printing cylinder may then be set individually to the predefined or calculated rotary angle position before the start of the printing process.

Measuring the distances is preferably carried out during the feeding of the printing material or the printing-material web, as follows:

At the unwind, during the feed operation, the paper path is determined continuously, for which purpose corresponding measuring devices are used. A marking, which is applied either to the printing material or to the feeding device, is registered by means of sensors on the printing mechanisms and on the cutting unit. These sensors are fitted at known distances in relation to the individual printing points and the cut edge. During the web feeding operation, the respectively selected printed mechanisms are passed through in the respectively applicable sequence by means of the web feeding device and the printing material. At the same time, the associated web-path distances are read out. In this way, the respectively current distances of the printing mechanisms in relation to one another and to the cut edge at the cutting unit are determined by computation, in each case referred to the web length. If as an alternative, instead of one printing mechanism, a different printing mechanism is used or activated, correspondingly different web lengths apply.

These web lengths can be assigned to the respectively applicable rotary angle positions of these printing cylinders, referred to the rotary angle position of the cutting cylinder, taking into account the circumferential length of the printing cylinders. The feeding of the web is preferably carried out using a web feeding device, as is virtually standard in modern web-fed rotary printing machines. The marking can then be applied both on the feeding device and directly on the printing material, for example in the form of a black adhesive strip which can be read optically.

Following the determination of the web lengths directly after the web feeding, it is usual for the printing material to be tensioned during printing operation, so that the value which is critical for printing operation can deviate slightly from said web lengths. This factor will always exhibit similar values for a selected printing material, so that an advantageous feature of the invention is that this correction can be inserted automatically or taken into account at the same time.

Since the values obtained by this means for the same printing material depend only on the current web value, it is also advantageously possible not only to store these values temporarily as necessary but to store them in the long term and to use them automatically in the case of selected web paths in repeat jobs. In this case, before the beginning of printing, the rotary angle positions of all the printing cylinders involved in the printing process are coordinated with one another and with the cutting cylinder.

BRIEF DESCRIPTION OF THE DRAWINGS

In the following text, the invention will be described using an advantageous exemplary embodiment and with reference to the appended drawing which schematically illustrates the inventive printing machine.

DETAILED DESCRIPTION OF THE PREFERRED EMBODIMENTS

Illustrated in the drawing are printing units 1–3 and printing units 5 and 6 and printing units 7 and 8, it being possible to see a further printing unit 4 above the printing unit 3. This results in a complex arrangement of a web-fed rotary offset printing machine, which is designated by 10 in the drawing.

It goes without saying that the invention can also be used for printing machines of simpler design, for example in the form of the printing units 1–3 or 5 and 6. It is also within the scope of the invention to design the printing units otherwise, for example in the form of four so-called bridge printing units or printing mechanisms arranged one above another, it being possible in turn for a number of such four-part towers to be arranged one above another or beside one another. In principle, in this case the printing units 1 to 8 illustrated would merely have to be rotated through 90° it then being possible for the printing-material webs to be printed to be guided horizontally and/or vertically through the printing mechanisms or printing towers on a large number of possible paths, corresponding to the respective print job.

For the purpose of defining terms, reference should be made to the fact that a printing unit usually comprises one printing mechanism, a printing mechanism, as is known, in turn comprising a plate cylinder and a blanket cylinder. In the exemplary embodiment shown and described here, the printing units 1–8 therefore all comprise two printing mechanisms arranged one above another in each case, in each case the upper printing mechanism being arranged above and the lower printing mechanism being arranged below the web to be printed.

Moreover, the drawing reveals a cutting device (cutting unit) 9 having two cylinders, of which the upper is the cutter cylinder, using which the printing-material webs led through between the pair of cylinders are cut.

In the exemplary embodiment described here, three reel changers, unwinds 11, 12, 13 here, are used from which in each case a printing-material web 14, 15, 16 is fed to the printing units 1 to 3 or 1, 2 and 4 and to the printing units 5 and 6 and 7 and 8. Following the printing of the individual printing-material webs 14 to 16 led horizontally through the printing units 1 to 8, said webs are led together and, in the cutting device 9, are cut at predetermined points in order to obtain the desired printed copies.

According to an advantageous embodiment of the invention, web-path measuring devices 17, 18, 19 are respectively provided on the printing-material webs 14 to 16, in which devices sensors are preferably used with the aid of which in each case a marking on the printing-material web is determined, so that during the feeding operation, the paper path (web length) can be registered continuously.

For simplicity, the above described construction of each printing unit 1–8 can be seen in detail only in the printing unit 1, in which the upper printing mechanism comprises a plate cylinder 20 and a blanket cylinder 21, and the lower printing mechanism comprises a plate cylinder 23 and a blanket cylinder 22. This designation applies with the same effect to the other printing units or printing mechanisms.

In order to guide the printing-material webs 14 to 16 along the desired paths, web guide rollers 24 to 31 are provided. In addition, there are sensors 32 to 39 on the printing mechanisms or at a predetermined distance from the same or from the printing points which result between adjacent blanket cylinders e.g. 21, 22. This means the points of contact between the two blanket cylinders. A further sensor 40 is located at a predetermined distance upstream of the cutting unit 9.

For reasons of simplification, a drive motor 1, 42 for the upper and lower plate cylinder in each case is indicated only on the printing mechanism 7. It goes without saying that a separate motor can also be assigned to all the plate cylinders and/or all the blanket cylinders or, as indicated on the printing unit 7, in each case only the plate cylinder 20 or 23 is provided with a drive motor and the associated blanket cylinders 21, 22 can be driven via a mechanical drive connection, for example via spur gears. Alternatively, the drive motors 41, 42 an also be arranged on the blanket cylinders 21, 22 and the associated plate cylinder is driven from this, for example via spur gearing. In addition, there is also the possibility of assigning only a single motor to each of the printing units 1 to 8, the three remaining cylinders then being connected to the driven cylinder via mechanical connections, for example likewise via spur gearing. In this case, however, the invention can be applied only to the extent that only the cut register can be preset for each printing unit 1 to 8, with the aid of the drive motor.

In order to be able to set the color register (circumferential register) as well, a motor must be provided at least in the case of each blanket-cylinder/plate-cylinder pair. Drive configurations of this type are known from the prior art according to DE 44 30 693 A1, to which reference is made.

Driving the electric motors used in the printing machine 10 is in each case done by using one or more computing and storage units, in which the values scanned or determined by the sensors can be further processed and fed to a motor control system 44, from which the individual cylinders involved in the printing or associated motors are driven. The computing and storage unit is merely indicated schematically at 43.

The web path length in each case from a printing mechanism (e.g. printing unit 1) or a printing point to the sensor is designated by 45, while the distance between the printing mechanisms 1–8 is in each case distinguished by the reference symbols 46 to 48. Indicated only schematically or dashed at 58 is a web feeding device, such as is used generally in modern printing machines. This normally extends at the side beside the feeding path of the web to be fed in and comprises a large number of diverters, in order to permit the widest possible range of web guidance paths for the necessary print jobs. A feeding unit is indicated at 75, 49, 55.

As already explained, a web-path measuring device is provided on the reel changers 11 to 13, in each case in the vicinity of the printing-material web 14 to 16, and is used during the feeding operation to determine the paper path continuously. The marking applied to the web is in each case registered by one of the sensors 32 to 39 on the printing mechanisms 1 to 8, including the sensor 40 upstream of the cutting unit 9. These sensors are fitted at known distances in relation to the individual printing units 1 to 8 or the printing points formed by the points of contact of the blanket cylinders, and in relation to the cut edge in the cutting unit 9. During the feeding of the web, the respectively selected printing mechanisms or printing units 1 to 9 are passed through in the applicable sequence by means of the web feeding device 58 and the printing-material webs 14 to 16. At the same time, with the aid of the computing and storage circuit 43, the associated path distances are determined. In this way, the respectively current distances of the printing mechanisms from one another and from the cut edge in the cutting unit 9 are determined, so to speak by computation, specifically in each case referred to the web length. If, alternatively, instead of the printing unit 3, the printing unit 4 is used, then the web lengths 56 and 57 apply instead of the web length 47, 48. It is therefore always possible, with the aid of the computing and storage circuit 43, for the web length to be calculated and, from this, the rotary angle position to be set for the cylinders involved in the printing to be detected. These web lengths can in each case be assigned respectively applicable rotary angle positions of these printing cylinders, as referred to the rotary angle position of the cutting cylinder, taking into account the circumferential length of the printing cylinders. As explained at the beginning, it is advantageously possible for a correction factor to be taken into account in relation to the respectively determined value, in order to compensate for the tensioning of the printing-material web during printing operation.

The invention also comprises, as a separate idea or concept, the possibility of using the known distances, necessitated by the construction, between the printing units or printing points when calculating or determining the presetting values for cut register and/color register and, from these distances, of determining the actually needed web length between two printing points, between which the web is led in each case, if necessary by means of a correction factor. When this principle is used, it is not necessary to use sensor. Instead, as an important principle, the paths advantageously used by means of setting the diverters in the web feeding device are used as a basis for this and, from these path feeding values, in conjunction with the distance values necessitated by the construction between the individual components of the printing machine and, advantageously using correction values for web stretch or elongation and so on, the setting value or the rotary angle position for presetting the cylinders involved in the printing can be determined. This concept has a self-contained and inventive character.

A further self-contained embodiment of the invention consists in that in each case, when a marking which is arranged on the web 14 to be fed in, and which can be registered by a sensor, e.g. 32, reaches the printing mechanism involved in the printing, e.g. 1, or the printing point between 21, 22, the drive motor, e.g. 41, 42 of the cylinder to be preset, e.g. 20, 23 is driven or its actual position is used as a basic actual position. With reference to this basic actual position, all the following cylinders in 2, 3 that are involved in the printing, or the motors driving said cylinders, are driven in order to preset the cylinders in 2, 3 (correct circumferential position) as the marking passes the respective printing point or printing mechanism or the associated sensor.

Thus while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention.

What is claimed is:

1. A web fed rotary offset printing machine, comprising:

a plurality of web paths having a plurality of components including a web path measuring device arranged on each of said web paths, a cutting unit, and a plurality of printing units, each of said plurality of printing units being associated with one of said web paths and comprising cylinders including at least one plate cylinder and at least one blanket cylinder, at least one of said cylinders of each of said plurality of printing units comprising a driven cylinder, and a separate motor for each of said driven cylinders;

means for determining a web path length between two of said components of said web paths between which a web to be printed is led;

a computing and storage unit; and a motor control system connected to said computing and storage unit and operatively connected to said separate motor for each of said driven cylinders, said computing and storage unit and said motor control system comprising means for adjusting at least one of said motors to preset a rotary angle of said cylinders relative to at least one of a cut register and a color register using said web path length determined by said means for determining.

2. The printing machine of claim 1, wherein said means for determining a web path length include sensors respectively arranged proximate each one of said components, wherein the webs to printed on each of said web paths include markings that are detectable by said sensors.

3. The printing machine of claim 1, further comprising a web feed device for each of said web paths, said web feed device feeding a web having markings, wherein said means for determining a web path length includes sensors respectively arranged proximate each one of said components of the web paths for detecting the markings.

4. The printing machine of claim 1, wherein said means for adjusting at least one of said motors comprises means for adjusting the rotary angle position of said printing units before the start of printing and means for regulating the cut register and color register during printing.

5. The printing machine of claim 1, wherein said means for adjusting comprises means for generating an adjustment value indicating a desired rotary angle position of one of said cylinders and sending the adjustment value from said computing and storage unit to said motor control system of the one of said separate motors of said one of said cylinders to be adjusted.

6. The printing machine of claim 3, wherein said means for determining a web path length between said two of said components includes means for determining a distance between two of said sensors respectively associated with said two of said components.

7. The printing machine of claim 5, wherein said computing and storage unit comprises means for storing said adjustment value for repeat jobs.

8. The printing machine of claim 1, wherein said means for determining a web path length comprises means for determining web path lengths for all distances between adjacent pairs of components of said web paths and means for adding the distances between adjacent pairs of said components for each of said web paths to determine the total distance of said web paths.

9. The printing machine of claim 3, wherein said means for adjusting comprises means for registering, by one of said sensors, a position of one of said printing units of one of the web paths when a marking on the web led through said one of the web pathways is detected by a sensor associated with said one of said printing units and means for adjusting the other ones of the components in said one of said web paths relative to said registered position.

* * * * *